US012275613B2

(12) United States Patent
Orii

(10) Patent No.: US 12,275,613 B2
(45) Date of Patent: Apr. 15, 2025

(54) RECORDING DEVICE AND PROGRAM

(71) Applicant: SEIKO EPSON CORPORATION, Tokyo (JP)

(72) Inventor: Satoru Orii, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 112 days.

(21) Appl. No.: 18/185,147

(22) Filed: Mar. 16, 2023

(65) Prior Publication Data

US 2023/0294942 A1 Sep. 21, 2023

(30) Foreign Application Priority Data

Mar. 17, 2022 (JP) ..... 2022-042277

(51) Int. Cl.

| | |
|---|---|
| ***B65H 7/02*** | (2006.01) |
| ***B65H 5/06*** | (2006.01) |
| ***B65H 7/06*** | (2006.01) |
| ***B65H 7/20*** | (2006.01) |
| ***B65H 9/00*** | (2006.01) |

(52) U.S. Cl.

CPC ..... *B65H 7/02* (2013.01); *B65H 5/068* (2013.01); *B65H 7/06* (2013.01); *B65H 7/20* (2013.01); *B65H 9/00* (2013.01); *B65H 2407/20* (2013.01); *B65H 2511/24* (2013.01); *B65H 2551/10* (2013.01); *B65H 2551/21* (2013.01); *B65H 2553/82* (2013.01); *B65H 2801/06* (2013.01)

(58) Field of Classification Search

CPC ..... B65H 9/00; B65H 9/20; B65H 2511/24; B65H 7/14; B65H 7/20; B65H 2407/20; B65H 2407/21; B65H 7/02; B65H 5/068

See application file for complete search history.

(56) References Cited

U.S. PATENT DOCUMENTS

| | | | | |
|---|---|---|---|---|
| 7,942,408 | B2 * | 5/2011 | Kato | B65H 7/08 271/226 |
| 8,043,016 | B2 * | 10/2011 | Kogure | B41J 11/0095 400/279 |
| 9,926,156 | B2 * | 3/2018 | Sato | G03G 15/6514 |
| 2015/0115525 | A1 * | 4/2015 | Deno | B65H 9/006 271/265.01 |
| 2022/0297962 | A1 * | 9/2022 | Kado | B65H 7/06 |

FOREIGN PATENT DOCUMENTS

| | | | |
|---|---|---|---|
| JP | 2012-076902 | A | 4/2012 |

* cited by examiner

*Primary Examiner* — Jeremy R Severson
(74) *Attorney, Agent, or Firm* — WORKMAN NYDEGGER

(57) ABSTRACT

A recording device includes an edge detection unit configured to detect an edge of a medium on a conveyance path, and a control unit configured to receive detection information from the edge detection unit, wherein the control unit acquires, based on the detection information from the edge detection unit, a direction of skewing of the medium and/or an amount of the skewing on the conveyance path and outputs skewing information including the direction of the skewing and the amount of the skewing.

7 Claims, 12 Drawing Sheets

RECORDING DEVICE AND PROGRAM

The present application is based on, and claims priority from JP Application Serial Number 2022-042277, filed Mar. 17, 2022, the disclosure of which is hereby incorporated by reference herein in its entirety.

BACKGROUND

1. Technical Field

The present disclosure relates to a recording device that performs recording on a medium. The present disclosure also relates to a program executed by a control unit in the recording device.

2. Related Art

A method of detecting a skewing of a recording medium when the recording medium is fed has been proposed for a printer which is a typical recording device, as in JP-A-2012-76902. According to the description in JP-A-2012-76902, a user is notified of the fact that a recording medium fed is skewed, using an alarm, a lamp lit, a warning message, and the like.

The printer described in JP-A-2012-76902, which simply notifies the user of the fact that a recording medium fed is skewed, using an alarm, a lamp lit, a warning message, and the like has room for improvement in terms of usability since there is no information about the skewing of the recording medium.

SUMMARY

A recording device according to the present disclosure for solving the problem described above includes a conveyance path through which a medium is conveyed, a recording unit configured to perform recording on the medium at the conveyance path, a conveyance unit located upstream of the recording unit on the conveyance path, and configured to convey the medium toward the recording unit, an edge detection unit configured to detect an edge of the medium on the conveyance path, and a control unit configured to receive detection information from the edge detection unit, wherein the control unit acquires a direction of skewing of the medium on the conveyance path and an amount of the skewing based on the detection information from the edge detection unit, and the control unit outputs skewing information including the direction of the skewing and/or the amount of the skewing.

In a non-transitory computer-readable storage medium storing a program according to the present disclosure, the program is executed by a control unit of a recording device, the recording device including a conveyance path through which a medium is conveyed, a recording unit configured to perform recording on the medium at the conveyance path, a conveyance unit located upstream of the recording unit on the conveyance path, and configured to convey the medium toward the recording unit, an edge detection unit configured to detect an edge of the medium on the conveyance path, and the control unit configured to receive detection information from the edge detection unit, and the program is configured to acquire a direction of skewing of the medium on the conveyance path and an amount of the skewing based on the detection information from the edge detection unit, and output skewing information including the direction of the skewing and/or the amount of the skewing.

DESCRIPTION OF EXEMPLARY EMBODIMENTS

Figure 1A:
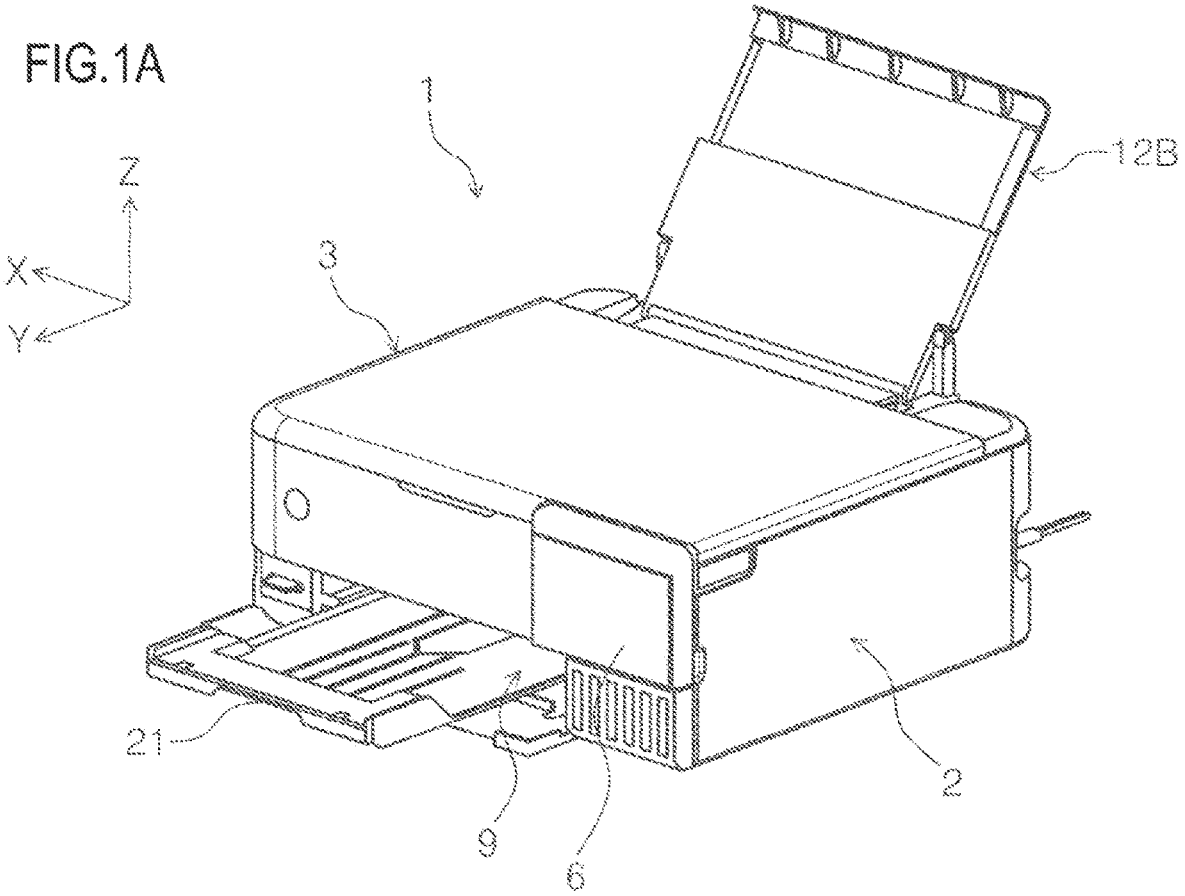
FIG. 1A is a front perspective view of a printer.

The present disclosure will be schematically described below.

A recording device according to a first aspect includes a conveyance path through which a medium is conveyed, a recording unit configured to perform recording on the medium at the conveyance path, a conveyance unit located upstream of the recording unit on the conveyance path, and configured to convey the medium toward the recording unit, an edge detection unit configured to detect an edge of the medium on the conveyance path, and a control unit configured to receive detection information from the edge detection unit, wherein the control unit acquires a direction of skewing and/or an amount of the skewing of the medium on the conveyance path based on the detection information from the edge detection unit, and the control unit outputs skewing information including the direction of the skewing and the amount of the skewing.

According to the present aspect, the control unit acquires the direction of the skewing and the amount of the skewing of the medium on the conveyance path based on the detection information from the edge detection unit, and outputs the skewing information indicating the direction of the skewing and/or the amount of the skewing. Thus, the user can recognize not only the occurrence of the skewing but also the direction of the skewing and the amount of the skewing, and select the processing to be executed based on such information, whereby usability can be improved.

According to a second aspect, in the first aspect, a display unit configured to display various types of information under control of the control unit is further included, and the control unit causes the display unit to display an angle of the skewing as the skewing information.

According to the present aspect, the control unit causes the display unit to display the angle of the skewing as the skewing information. Thus, the user can recognize the angle of the skewing and then select the appropriate processing.

According to a third aspect, in the second aspect, the control unit causes the display unit to graphically display the direction of the skewing of the medium as the skewing information.

According to the present aspect, the control unit causes the display unit to graphically display the direction of the skewing of the medium as the skewing information, so that the user can more easily recognize the skewing.

According to a fourth aspect, in the second or third aspect, the control unit causes the display unit to display information about displacement of a recording image with respect to the medium as the skewing information.

According to the present aspect, the control unit causes the display unit to display the information about the displacement of the recording image with respect to the medium as the skewing information. Thus, the user can select the appropriate processing to be executed based on the information about the displacement.

According to a fifth aspect, in any of the second to fourth aspects, the control unit includes a user interface with which a user selects any one of a first option for performing the recording regardless of the skewing, a second option for discharging the medium toward the upstream or downstream of the conveyance unit on the conveyance path without performing the recording, and a third option for manually correcting the skewing of the medium, and the control unit executes processing corresponding to the option selected. According to the present aspect, the user can select a desired item based on the skewing information, whereby usability can be improved.

According to a sixth aspect, in the fifth aspect, the conveyance unit includes a roller pair configured to nip and convey the medium, and the control unit releases the nipping by the roller pair or reduces a nip load of the roller pair, when the third option is selected.

According to the present aspect, when the third option is selected, the control unit releases the nipping by the roller pair or reduces the nip load of the roller pair, whereby the rotation of the medium is facilitated so that the user can easily correct the skewing manually.

According to a seventh aspect, in any of the first to sixth aspects, the recording unit includes a recording head configured to eject ink onto the medium, the recording head being provided to a carriage movable in a width direction intersecting a direction in which the medium is conveyed, and the edge detection unit includes an optical sensor provided to the carriage at a position to face the medium.

According to the present aspect, when the edge detection unit includes the optical sensor provided to the carriage, the advantageous effect of any of the first to the sixth aspects described above can be obtained.

According to an eighth aspect, in any of the first to seventh aspects, the control unit outputs the skewing information to a portable information terminal capable of communicating with the control unit.

According to the present aspect, with the control unit configured to output the skewing information to the portable information terminal capable of communicating with the control unit, the advantageous effect of any of the first to the seventh aspects described above can be obtained.

In a non-transitory computer-readable storage medium storing a program according to a ninth aspect, the program is executed by a control unit in a recording device, the recording device including a conveyance path through which a medium is conveyed, a recording unit configured to perform recording on the medium at the conveyance path, a conveyance unit located upstream of the recording unit on the conveyance path and configured to convey the medium toward the recording unit, an edge detection unit configured to detect an edge of the medium on the conveyance path, and the control unit configured to receive detection information from the edge detection unit, and the program is configured to acquire a direction of skewing of the medium on the conveyance path and an amount of the skewing based on the detection information from the edge detection unit, and output skewing information including the direction of the skewing and the amount of the skewing.

According to the present aspect, the program is configured to acquire the direction of the skewing and the amount of the skewing of the medium on the conveyance path based on the detection information from the edge detection unit, and output the skewing information indicating the direction of the skewing and the amount of the skewing. Thus, the user can recognize not only the occurrence of the skewing but also the direction of the skewing and the amount of the skewing, whereby usability can be improved.

The present disclosure will be specifically described below.

An inkjet printer 1 is described below as an example of a recording device. Hereinafter, the inkjet printer 1 is simply referred to as a printer 1.

Note that, in an X-Y-Z coordinate system illustrated in each figure, an X axis direction is a device width direction and is a width direction of a medium on which the recording is performed.

A Y axis direction is a device depth direction, and is along a medium conveyance direction at the time of the recording. A +Y direction is a direction from the device back surface toward the front surface, and −Y direction is a direction from the device front surface toward the back surface of the device. In the present embodiment, of the side surfaces forming the circumference of the printer 1, a side surface provided with an operational panel 6, that is, a side surface in the +Y direction is the device front surface, and a side surface in the −Y direction is the device back surface.

A Z axis direction is a direction along a vertical direction, and is a device height direction. A +Z direction is the vertically upward direction, and the −Z direction is the vertically downward direction.

In the description below, a direction in which the medium is sent may be referred to as "downstream" and a direction opposite thereto may be referred to as "upstream".

The terms "recording" and "printing", which may be used in the specification, both mean inkjet recording performed on the medium as an example in the present embodiment. Regarding the terms "medium" and "sheet", which may be used in the specification, the "sheet" is an example of the "medium".

In FIG. 1, the printer 1 includes a scanner unit 3, which is an example of an image reading device, in an upper portion of a device body 2 that performs inkjet recording on a medium, and thus is configured as a multifunction peripheral having a document reading function in addition to an inkjet recording function. An example of the medium is a recording sheet.

As illustrated in FIG. 1A, the device body 2 has, on the device front surface, the operational panel 6 that is used for making various operation settings, displaying a preview of contents of the recording setting and a recording image, and the like. The operational panel 6 is formed as a touch panel in the present embodiment, and thus displays various types of information and also provides a user interface (hereinafter, referred as "UI") to receive various setting operations made by a user. Thus, in the printer 1, the operational panel 6 functions as a display unit that displays various types of information. The user performs various setting operations and execution operations according to the UI displayed on the operational panel 6.

In addition to the operational panel 6, a medium cassette 10, a medium discharge port 9, and a medium receiving tray 21 are disposed on the device front surface.

Figure 1B:
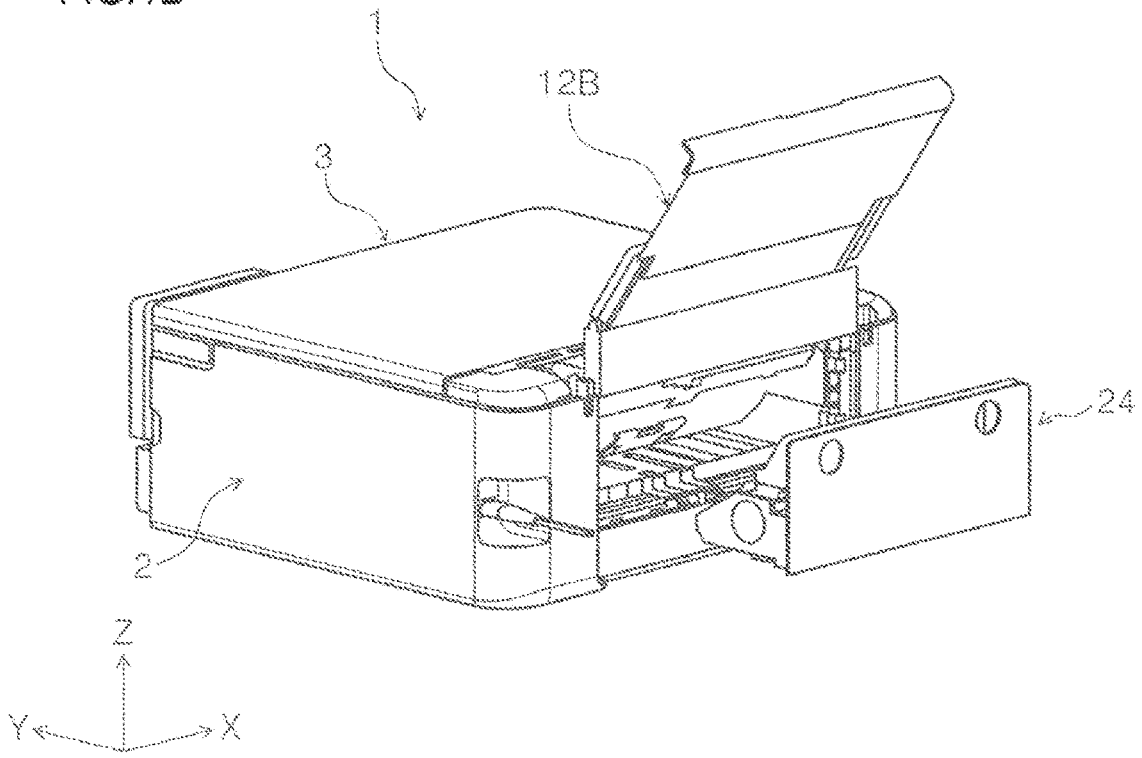
FIG. 1B is a back perspective view of the printer.

An extension support part 12B is provided in a device rear upper portion to be upwardly expandable. As illustrated in FIG. 1B, a reversing unit 24 is provided to the device back side, to detachably attached to the device body 2.

A feed path or a conveyance path of the medium in the printer 1 will be described with reference to FIG. 2 and FIG. 3. The printer 1 has three medium feed paths that are a medium feed path T1 for feeding the medium from the medium cassette 10 in a device bottom portion, a medium feed path T2 for feeding the medium from a device rear upper portion, and a medium feed path T3 for feeding the medium from the device back surface.

Reference sign T4 denotes a medium conveyance path between a feed roller pair 15 and a discharge roller pair 19. These medium feed paths T1, T2, and T3 are all coupled to the medium conveyance path T4.

On the medium feed path T1, the medium is fed in the −Y direction by a pick roller 11 from the medium cassette 10 serving as a medium container, curved and reversed by a reversing roller 20, and then is sent in the +Y direction toward a recording head 17, that is, toward the feed roller pair 15.

As described above, the medium feed path T1 includes a curve reverse path on which the medium fed from the medium cassette 10 is curved and reversed by the reversing roller 20.

A transport motor 53 (see FIG. 5) serves as a power source for the pick roller 11 and the reversing roller 20. Driven rollers 22*a*, 22*b*, and 22*c* are provided along the outer circumference of the reversing roller 20.

On the medium feed path T2, the medium supported to be in an inclined orientation by an inclined supporting part 12A and the extension support part 12B is sent toward the feed roller pair 15 by a feed roller 13 and an auxiliary roller 14. Thus, the medium feed path T2 is a path through which the medium set in the device rear upper portion is fed. The transport motor 53 (see FIG. 5) serves as a power source for the feed roller 13 and the auxiliary roller 14.

The medium feed path T3 is a path for sending a manually fed medium from the device back surface toward the front surface. The medium feed path T3 is a substantially linear path extending in the horizontal direction in the present embodiment. The medium feed path T3 is formed by detaching the reversing unit 24 from the back surface side of the device body 2, detaching an adapter 23 provided to the reversing unit 24, and attaching the adapter 23 to the device body 2 as illustrated in FIG. 3. In other words, the reversing unit 24 attached serves as a unit body that closes the medium feed path T3.

The reversing unit 24 is configured to be removed from the back surface side of the device body 2 in the −Y direction as illustrated in FIG. 1B, and is configured as the unit body including the reversing roller 20. The adapter 23 is attached to the +Y direction side of an upper portion of the reversing unit 24 as illustrated in FIG. 2. When the medium is fed using the medium feed path T3, the adapter 23 is detached from the reversing unit 24, and attached to the printer 1 as illustrated in FIG. 3.

The adapter 23 is provided with a pair of edge guides 23*a* that guide end portions of the medium in the width direction. FIG. 3 illustrates the edge guide 23*a* provided on the +X direction side in the X axis direction. The pair of edge guides 23*a* are provided to be moved toward and away from each other by a rack pinion mechanism not illustrated.

The feed roller pair 15 that sends the medium to a position facing the recording head 17 is an example of a conveyance unit, and includes a feed roller 15*a* and a nip roller 15*b*. The transport motor 53 (see FIG. 5) serves as a power source for the feed roller 15*a*. The nip roller 15*b* is provided to be movable toward and away from the feed roller 15*a*, and is pressed by a compression spring 27 (see FIG. 4) toward the feed roller 15*a*, and is driven to rotate while nipping the medium with the feed roller 15*a*.

Figure 4:
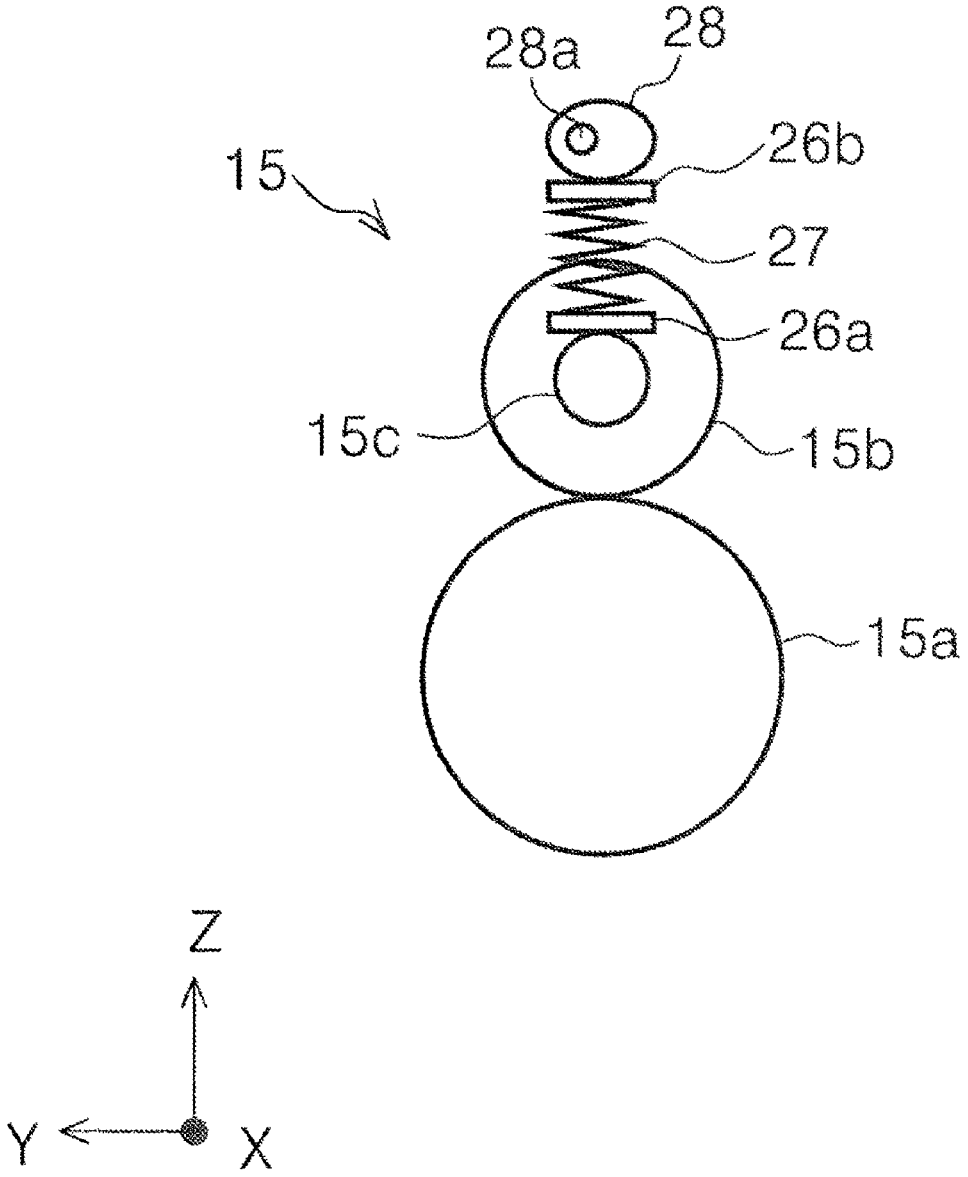
FIG. 4 is a diagram illustrating a configuration for adjusting a nip load of a feed roller pair.

As illustrated in FIG. 4, the compression spring 27 applies pressing force to a rotation shaft 15*c* of the nip roller 15*b* via a spring bearing 26*a*. An upper portion of the compression spring 27 is provided with a spring bearing 26*b* that is provided with an eccentric cam 28. The eccentric cam 28 rotates about a rotation shaft 28*a* that rotates upon receiving power from a cam motor 49 (see FIG. 5). When the eccentric cam 28 rotates, the length of the compression spring 27 is adjusted, and the nip load for nipping the medium with the nip roller 15*b* and the feed roller 15*a* is adjusted. In the present embodiment, the nip load can be switched between two levels that are a "large nip load", which is a nip load applied when the medium is conveyed, and a "small nip load", which is a nip load applied when skewing correction described below is performed. A control unit 50 (see FIG. 5) can recognize a phase of the eccentric cam 28 based on detection information from a rotation detection unit not illustrated, and switches the nip load based on the phase.

Referring back to FIGS. 2 and 3, the recording head 17, which is an example of a recording unit, and a medium support unit 18 are arranged to face each other on the downstream of the feed roller pair 15. In the present embodiment, the recording head 17 is configured as an inkjet recording head that ejects ink. The medium support unit 18 supports the medium to define a gap between the recording head 17 and the medium.

The recording head 17 is provided to a carriage 16 that can move back and forth in the medium with direction, and is powered by a carriage motor 51 (see FIG. 5) under the control by the control unit 50 (see FIG. 5) to move in the X axis direction The recording head 17 is not limited to a serial type that performs recording while moving in the X axis direction, and may be a line head that is fixedly provided.

The discharge roller pair 19 is provided on the downstream of the recording head 17 and the medium support unit 18. The discharge roller pair 19 includes a feed roller 19*a* and a nip roller 19*b*. The transport motor 53 (see FIG. 5) serves as a power source for the feed roller 19*a*. The nip roller 19*b* is provided to be movable toward and away from the feed roller 19*a*, and is pressed by a spring (not illustrated) toward the feed roller 19*a*, and is driven to rotate while nipping the medium with the feed roller 19*a*. The medium on which the recording has been performed is discharged to the outside of the device by the discharge roller pair 19, and is supported by the medium receiving tray 21.

Figure 5:
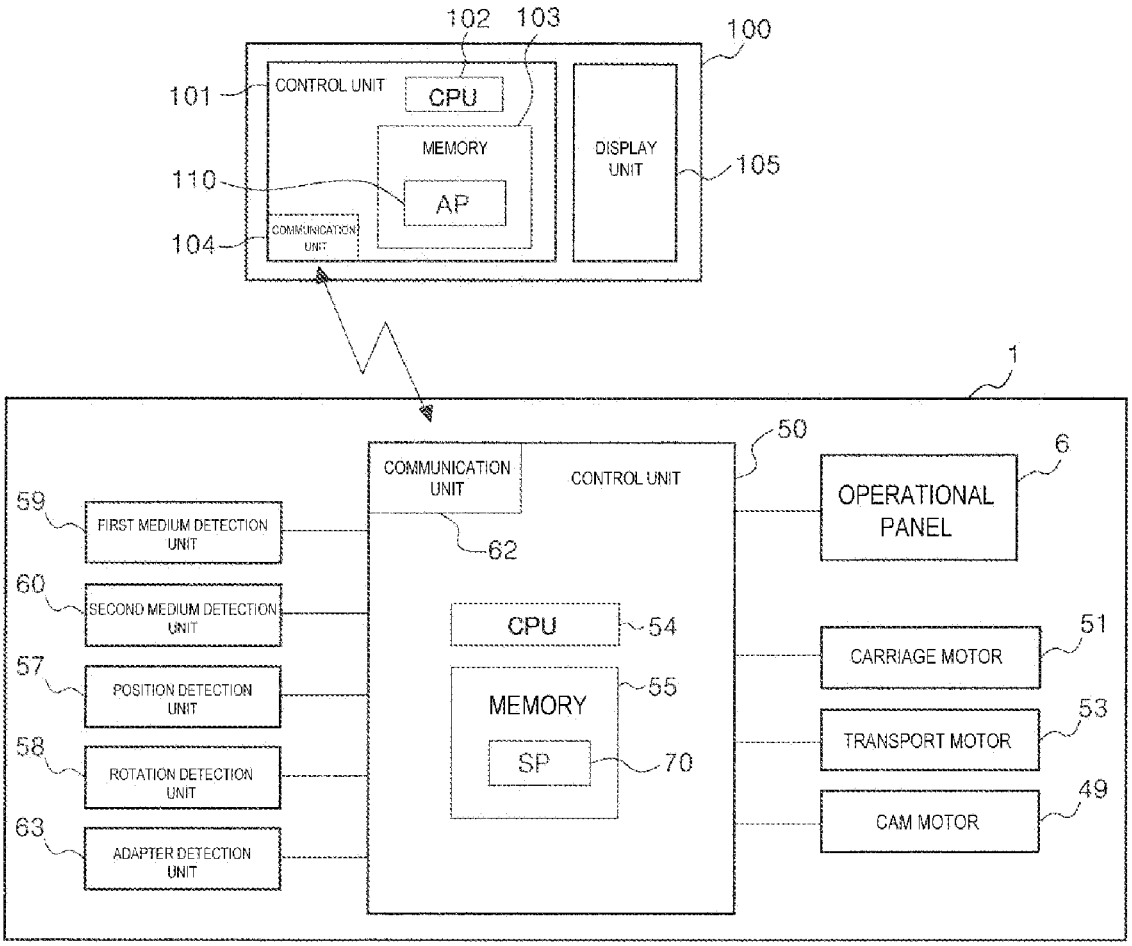
FIG. 5 is a block diagram illustrating a control system of the printer and a portable information terminal.

Next, a control system in the printer 1 will be described with reference to FIG. 5.

The control unit 50 performs various types of control of the printer 1 for feeding, conveying, recording, and discharging the medium in the device body 2, a document reading operation in the scanner unit 3, and the like. The control unit 50 receives a signal from the operational panel 6, and transmits a signal for providing a UI on the operational panel 6 to the operational panel 6.

The control unit 50 controls motors such as the carriage motor 51, the transport motor 53, and the cam motor 49. In the present embodiment, each of these motors is a DC motor. The control unit 50 also receives detection signals from detection units such as a position detection unit 57, a rotation detection unit 58, a first medium detection unit 59, a second medium detection unit 60, and an adapter detection unit 63.

The position detection unit 57 is a linear encoder, and detects the position of the carriage 16 in the X axis direction. The rotation detection unit 58 is a rotary encoder, and detects the amount and speed of the rotation of the transport motor 53.

The adapter detection unit 63 is provided to an attachment position for the adapter 23 (see FIG. 3) in the device body 2, and detects whether the adapter 23 is attached to the device body 2. In the present embodiment, the adapter detection unit 63 is configured by a contact sensor.

Figure 2:
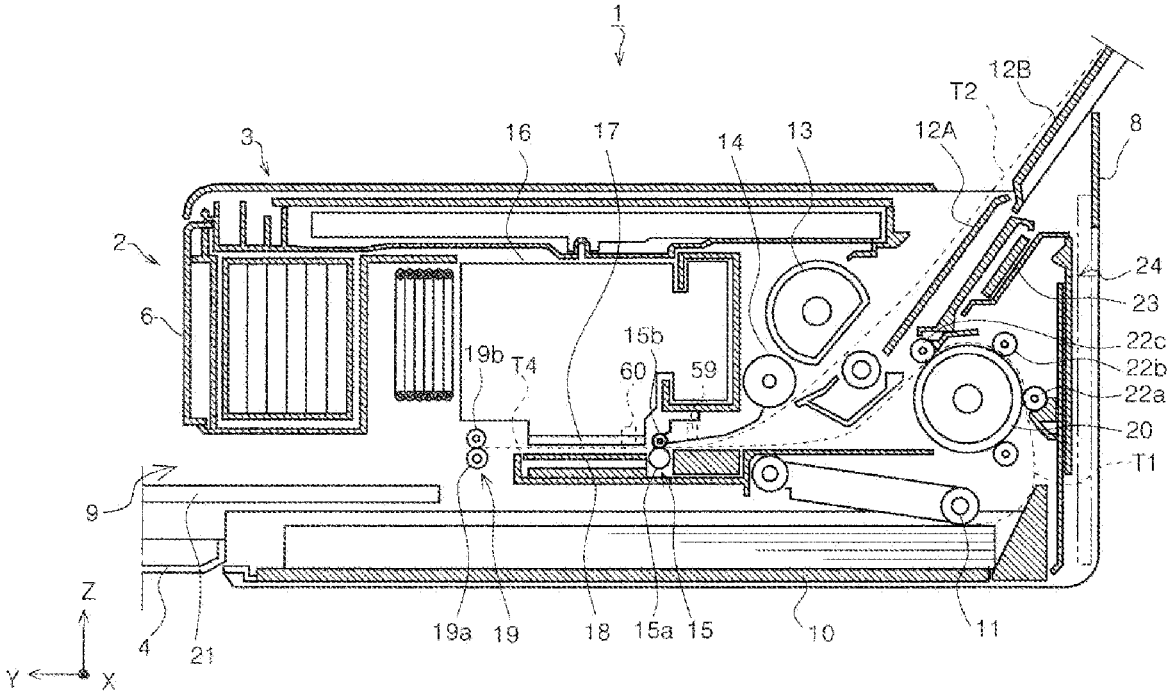
FIG. 2 is a diagram illustrating a conveyance path for a medium in the printer.
Figure 3:
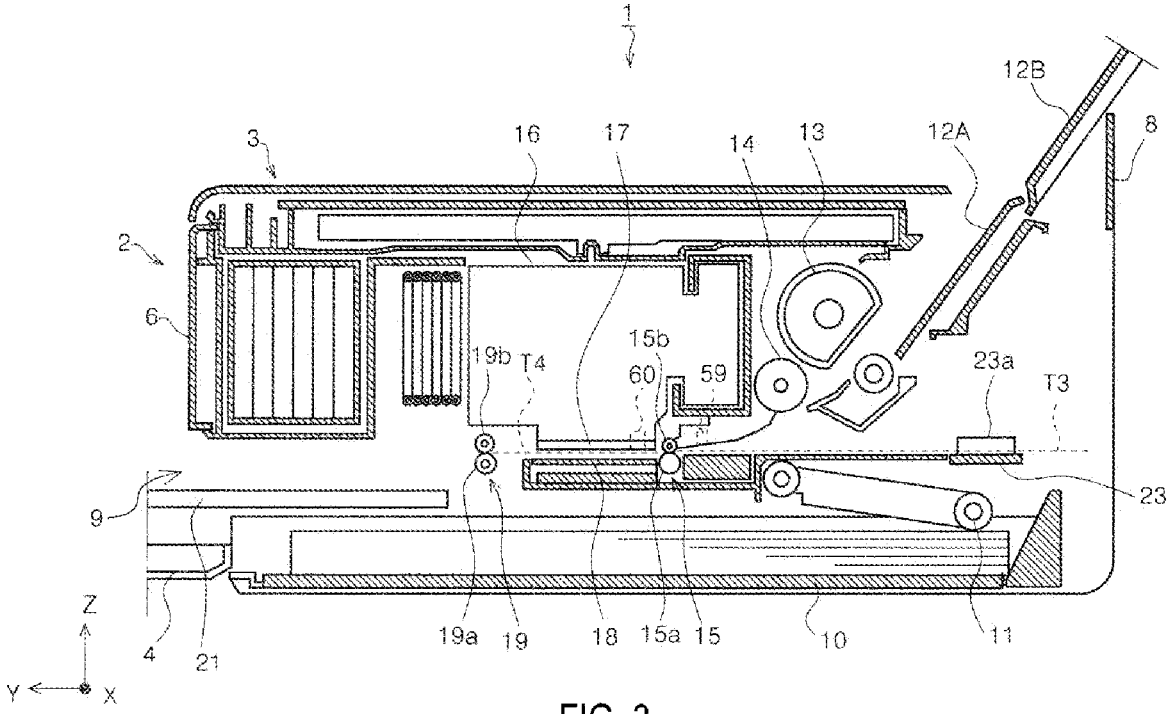
FIG. 3 is a diagram illustrating the conveyance path for the medium in the printer.

As illustrated in FIG. 2 and FIG. 3, the first medium detection unit 59 is provided on the upstream of and in the vicinity of the feed roller pair 15, and detects the passage of the leading end and trailing end of the medium. When the medium feed path T3 illustrated in FIG. 3 is used, when the leading end of the medium fed by the user from the device back side passes a position of detection by the first medium detection unit 59, the control unit 50 makes a speaker (not illustrated) emit a "beep" sound, makes the feed roller pair 15 start rotating, and waits for print data in a state where the medium fed has been sent toward the downstream by a predetermined amount.

The first medium detection unit 59 can be configured by a contact or contactless sensor.

The second medium detection unit 60 is an example of an edge detection unit provided to the carriage 16 at a position to face the medium, and is used for detection of an edge position of the medium in the Y axis direction, an edge position of the medium in the X axis direction, and the like. The second medium detection unit 60 is configured by an optical sensor including a light emitting unit that emits detection light and a light receiving unit that receives reflected light from the medium.

In the present embodiment, for the second medium detection unit 60, a contact image sensor (CIS) fixedly provided may be used instead of the optical sensor provided to the carriage 16.

The control unit 50 includes a CPU 54 and a memory 55. The CPU 54 performs various processes according to a program stored in the memory 55, and controls various operations in the device body 2 and the scanner unit 3. The memory 55 is a readable and writable nonvolatile memory, and is an example of a storage device. The memory 55 stores programs for performing various types of control on the device body 2 and the scanner unit 3, various parameters, and the like. A control program ("CP" in FIG. 5) 70 stored in the memory 55 transmits information related to the status of the printer 1, in particular the skewing information described below, to the operational panel 6 or a portable information terminal 100 as necessary. Various types of setting information input by the user using the operational panel 6 are also stored in the memory 55.

The control unit 50 includes a communication unit 62. The communication unit 62 is a communication module for performing wireless communications with an external device, and is a communication module for performing wireless Wi-Fi communications in the present embodiment. Wi-Fi is a scheme for executing wireless communications in accordance with the standard of IEEE802.11, which is an international standard.

The name "Wi-Fi" is a registered trademark of the Wi-Fi Alliance.

However, the communication unit 62 is not limited to this, and may be a communication module that performs wireless communications by a Bluetooth method conforming to the standard of IEEE802.15.1, which is an international standard, or may be infrared communications or another wireless communication method. The communication unit 62 may be configured to include more than one of the above-described various communication modules.

The printer 1 having the above-described configuration and the portable information terminal 100 that can communicate with the printer 1 form a recording system. An example of the portable information terminal 100 is a smartphone.

The portable information terminal 100 includes a control unit 101 and a display unit 105. The display unit 105 is formed as a touch panel in the present embodiment, and thus displays various types of information and also provides a UI to receive various setting operations made by a user. The user performs various setting operations and execution operations according to the UI displayed on the display unit 105.

The control unit 101 receives a signal from the display unit 105, and transmits a signal for providing a UI on the display unit 105 to the display unit 105.

The control unit 101 includes a CPU 102 and a memory 103. The CPU 102 performs various processes in accordance with a program stored in the memory 103, and controls the display unit 105.

The memory 103 is a readable and writable nonvolatile memory, and stores the program executed by the CPU 102, various parameters, and the like. Based on information transmitted from the printer 1, an application program ("AP" in FIG. 5) 110 stored in the memory 103 causes the display unit 105 to display a UI for operating the printer 1, which is, for example, the skewing information and processing UI described below.

The control unit 101 includes a communication unit 104. The communication unit 104 includes a communication module for performing wireless Wi-Fi communications, in addition to a communication module for performing mobile communications. The communication unit 104 may include a communication module for performing wireless Bluetooth communications, and a communication module for performing other types of wireless communications such as infrared communications. The communication unit 104 must be at least capable of establishing communication with the printer 1.

Next, detection of skewing when the medium is fed using the medium feed path T3 illustrated in FIG. 3 will be described. As described above, when the leading end of the medium fed to the medium feed path T3 by the user passes through the position of detection by the first medium detection unit 59, the control unit 50 sends the inserted media toward downstream and waits for print data. Upon receiving the print data, the control unit 50 executes processing illustrated in FIG. 6.

Figure 7:
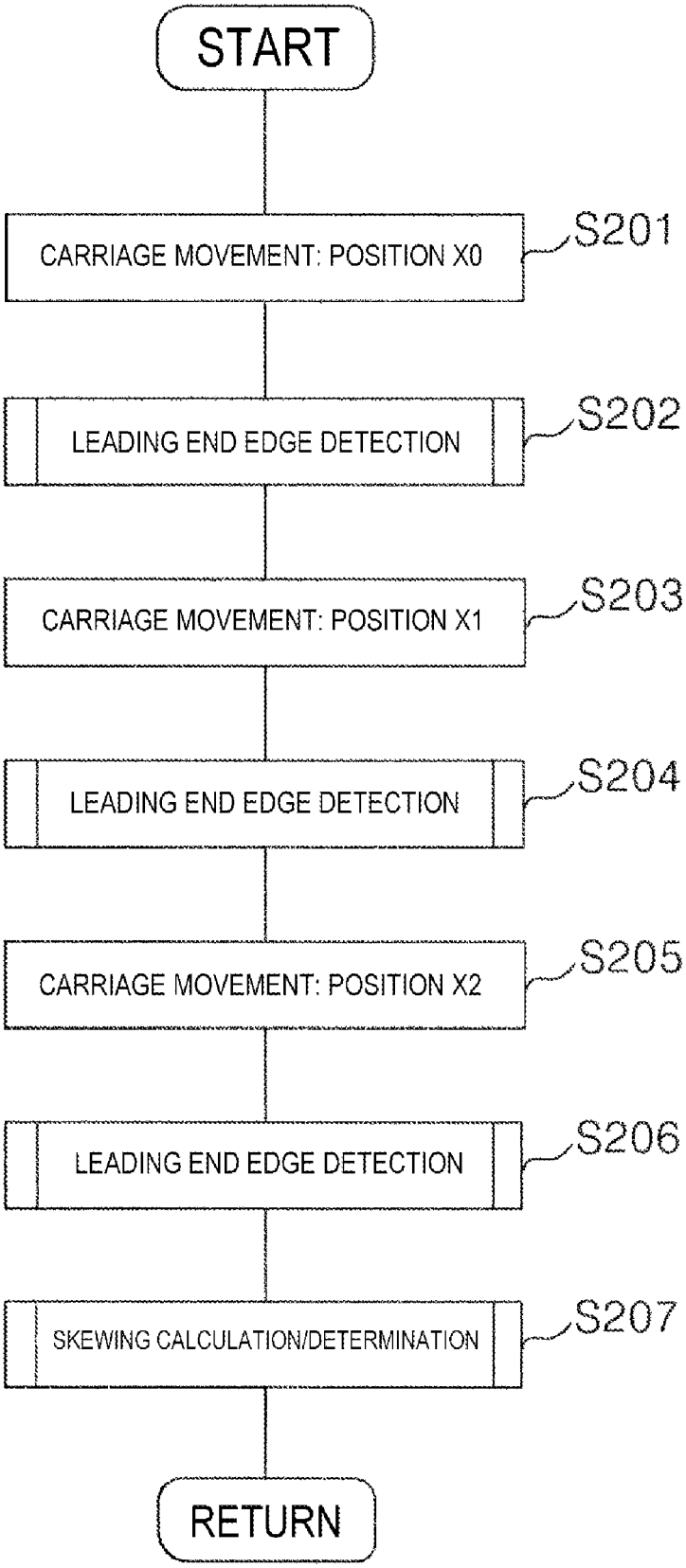
FIG. 7 is a flowchart illustrating the content of skewing detection.

First of all, the control unit 50 performs skewing detection (step S101). For example, the skewing detection is performed through the processing illustrated in FIG. 7. In FIG. 7, the control unit 50 moves the carriage 16 to arrange the second medium detection unit 60 at a position X0 in FIG. 8

Figure 8:
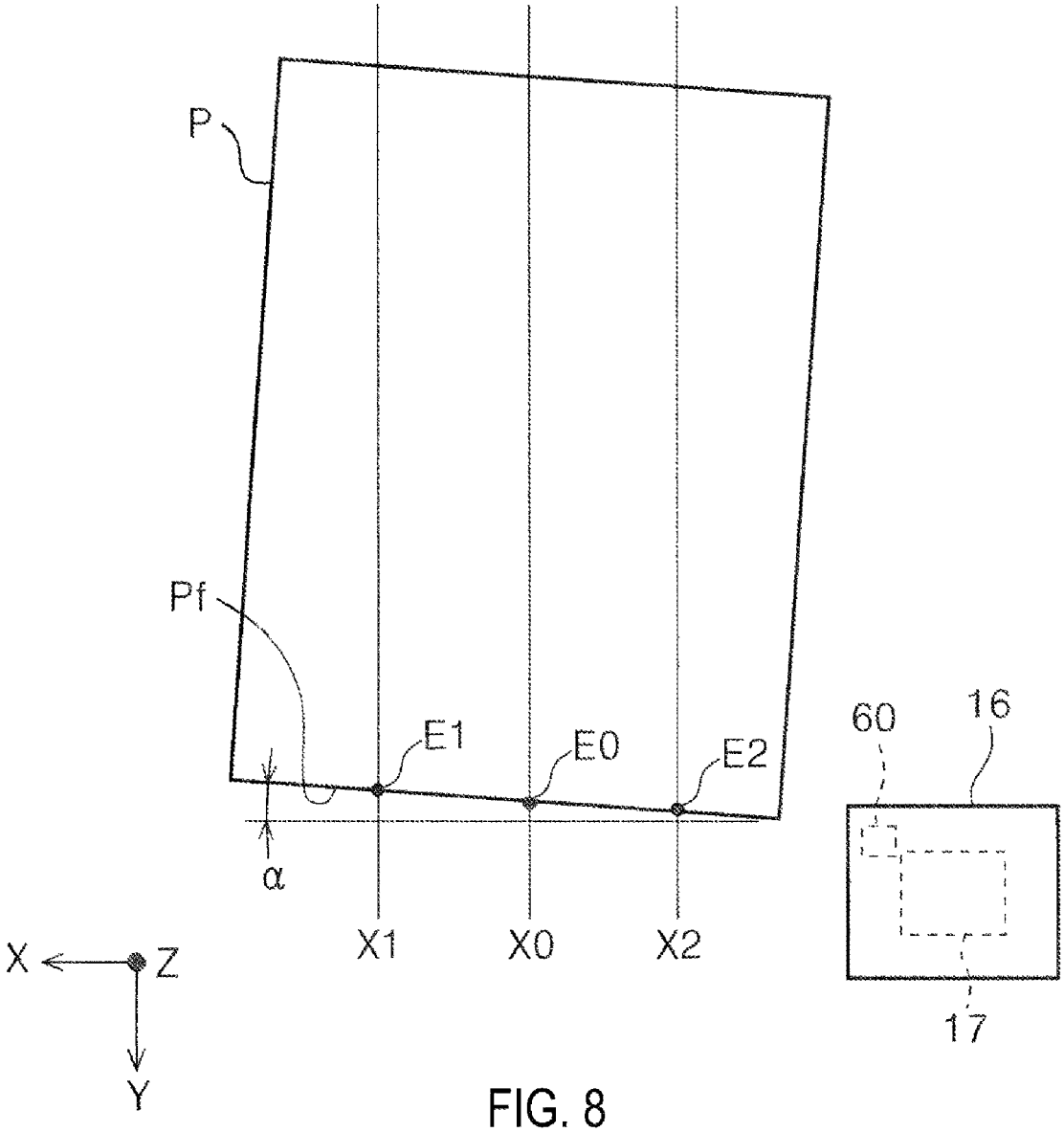
FIG. 8 is a diagram illustrating a position where a medium leading end edge is detected.

(step S201). The position X0 is the center position of a printable region in the X axis direction. In FIG. 8, reference sign P denotes a medium in a state of being skewed at an angle α. In this state, the control unit 50 acquires an edge position EQ of a leading end Pf of the medium P using the forward rotation and the backward rotation of the feed roller pair 15 (step S202).

Next, the control unit 50 moves the carriage 16 to arrange the second medium detection unit 60 at a position X1 in FIG. 8 (step S203). In this state, the control unit 50 acquires an edge position E1 of the leading end Pf of the medium P using the forward rotation and the backward rotation of the feed roller pair 15 (step S204).

Next, the control unit 50 moves the carriage 16 to arrange the second medium detection unit 60 at a position X2 in FIG. 8 (step S205). In this state, the control unit 50 acquires an edge position E2 of the leading end Pf of the medium P using the forward rotation and the backward rotation of the feed roller pair 15 (step S206).

The distance between the position X0 and the position X1 is the same as the distance between the position X0 and the position X2 in the X axis direction.

The control unit 50 calculates the skew angle α of the medium P based on coordinate values of the edge positions E0, E1, and E2 on an X-Y plane thus obtained (step S207). This skew angle α is of a positive or negative value, which also indicates the skewing direction. The skew angle α is an example of the skewing information.

Whether a printing region sticks out from the sheet when the printing is performed without correction is determined based on sheet size information included in the print data, the printing region, and the skew angle α (step S207). Whether the printing region sticks out from the sheet is an example of the skewing information, and is an example of information about displacement of a print image.

Referring back to FIG. 6, after performing the skewing detection in step S101, the control unit 50 transmits the skewing information and the information about the processing UI to the operational panel 6 (step S102). The operational panel 6 thus displays the skewing information and the processing UI.

When the connection with the portable information terminal 100 has been established, the control unit 50 may transmit the skewing information and the processing UI to the portable information terminal 100. In this case, the skewing information and the processing UI described below are displayed on the operational panel 6 of the printer 1, and also on the display unit 105 of the portable information terminal 100. In this case, the skewing information and the processing UI described below may be displayed only on the display unit 105 of the portable information terminal 100.

Figure 9:
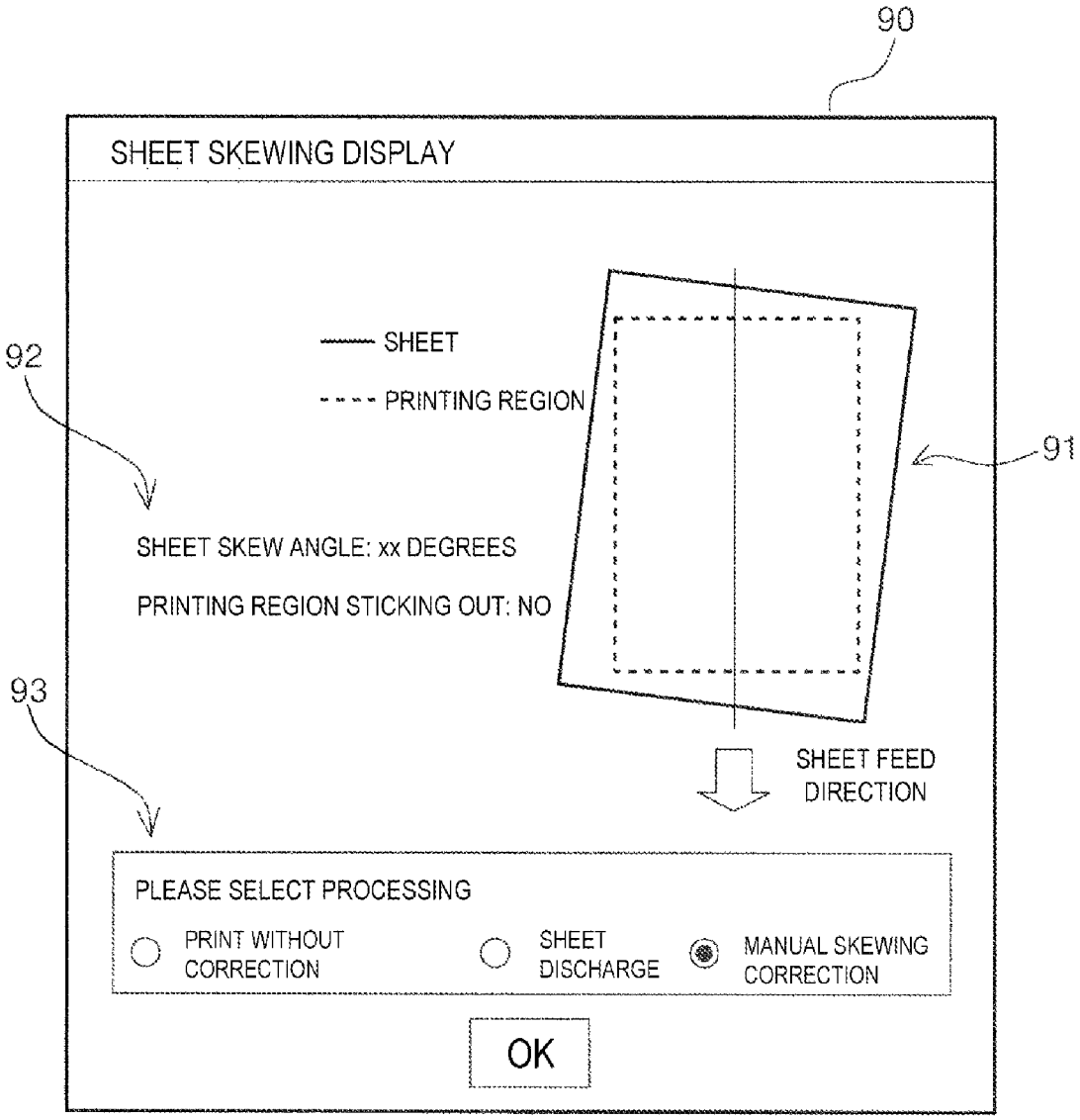
FIG. 9 is a diagram illustrating a UI for displaying skewing of the medium.

FIG. 9 illustrates an example of the skewing information and the processing UI. Reference sign 90 denotes the entirety of the UI, reference signs 91 and 92 denote the skewing information, and reference sign 93 denotes the processing UI.

The skewing information 91 is a graphic displayed to indicate a skewing direction of the medium P. The skewing information 92 indicates the skew angle α of the sheet and whether the printing region sticks out from the sheet. FIG. 9 illustrates an example of the display when the printing region does not stick out.

Figure 10:
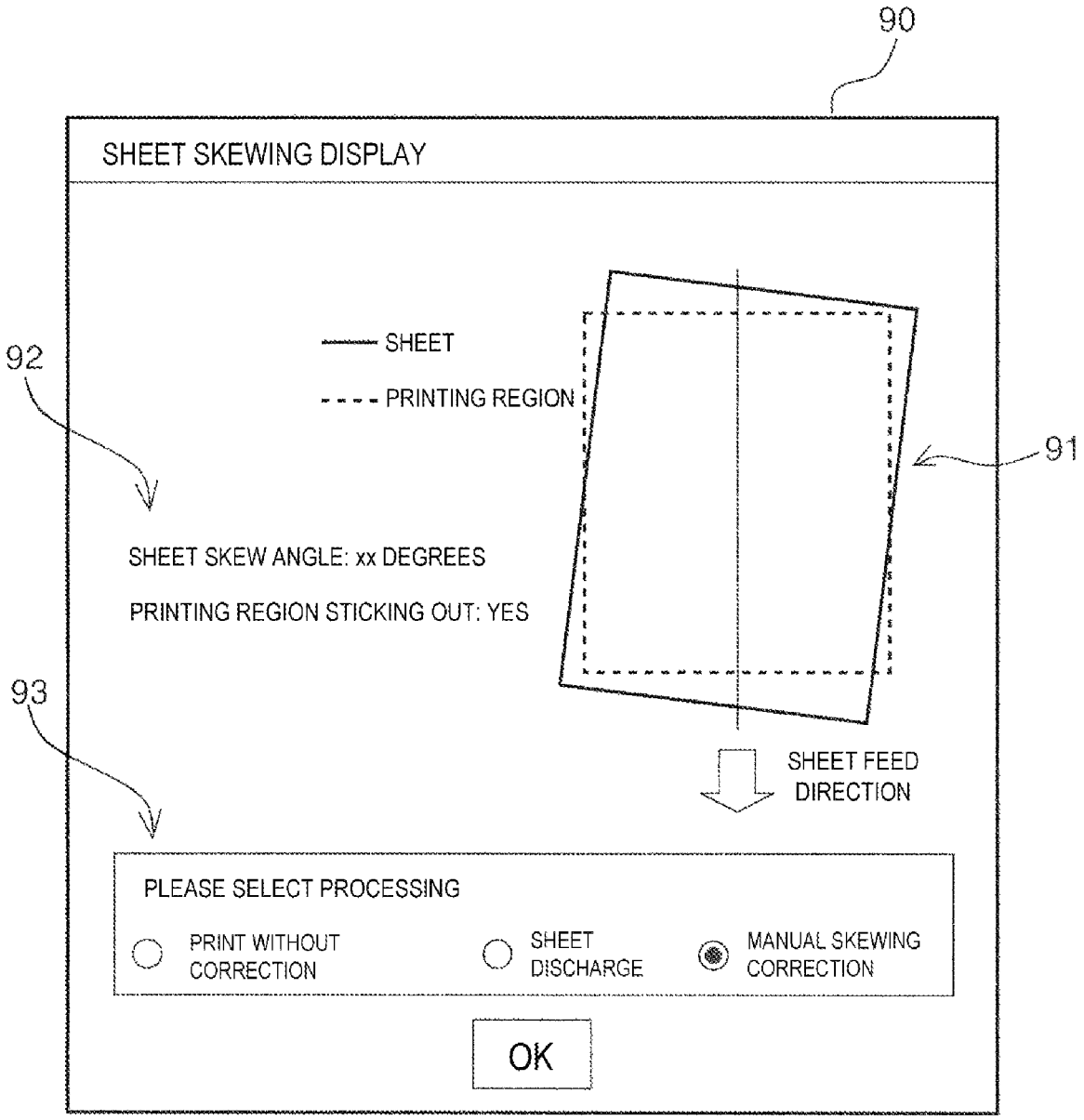
FIG. 10 is a diagram illustrating a UI for displaying skewing of the medium.

FIG. 10 illustrates an example of the display when the printing region sticks out. Preferably, the aspect ratio of the sheet, the aspect ratio of the printing region, the skew angle of the sheet, the ratio between the sheet and the printing region, the amount of the printing region sticking out, and the like indicated in the skewing information 91 preferably reflect the actual status, so that the user can intuitively recognize these statuses.

With the entire UI 90, the user recognizes the skew angle and skewing direction of the sheet fed as well as whether the printing region sticks out from the sheet, and selects any of items in the processing UI 93 based on such information.

Instead of or in addition to whether the printing region sticks out from the sheet when printing is performed without correction, for example, the amount of change in a margin at the trailing end of the sheet (a displacement amount of the printing region) may be displayed. With this configuration, the user can recognize the status of the trailing end of the sheet, when the sheet fed for printing is long in particular.

The processing UI 93 displays three options "print without correction", "sheet discharge", and "manual skewing correction" together with radio buttons. When the user selects any one of the options and presses an OK button, the processing corresponding to the option is executed.

The control unit 50 determines the option selected on the processing UI 93 (step S103), and executes the processing corresponding to the option selected. Specifically, the "print without correction" is an example of a first option, and when this option is selected, the control unit 50 executes recording on the medium P (step S104).

Figure 11:
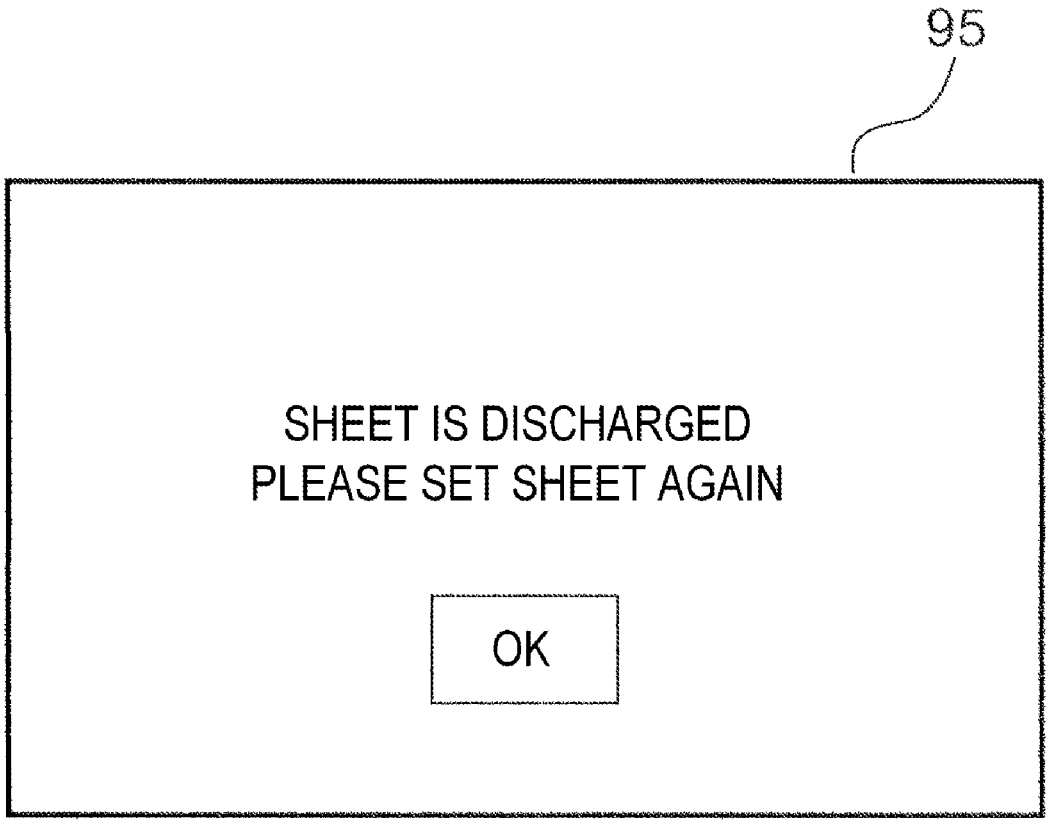
FIG. 11 is a diagram illustrating a UI when the medium is discharged.

The "sheet discharge" is an example of a second option, and when this option is selected, the control unit 50 displays a discharge UI (step S105). In FIG. 11, reference sign 95 denotes an example of the discharge UI, and when the user presses the OK button for this, the control unit 50 rotates the feed roller pair 15 in the backward direction to discharge the medium P toward the upstream (step S106). In step S106, the feed roller pair 15 may rotate in the forward direction to discharge the medium P onto the medium receiving tray 21 on the downstream. Still, with the medium P discharged toward the upstream, the medium P can be discharged with a shorter discharge path, whereby a risk of damaging the surface of the medium P is reduced.

Figure 12:
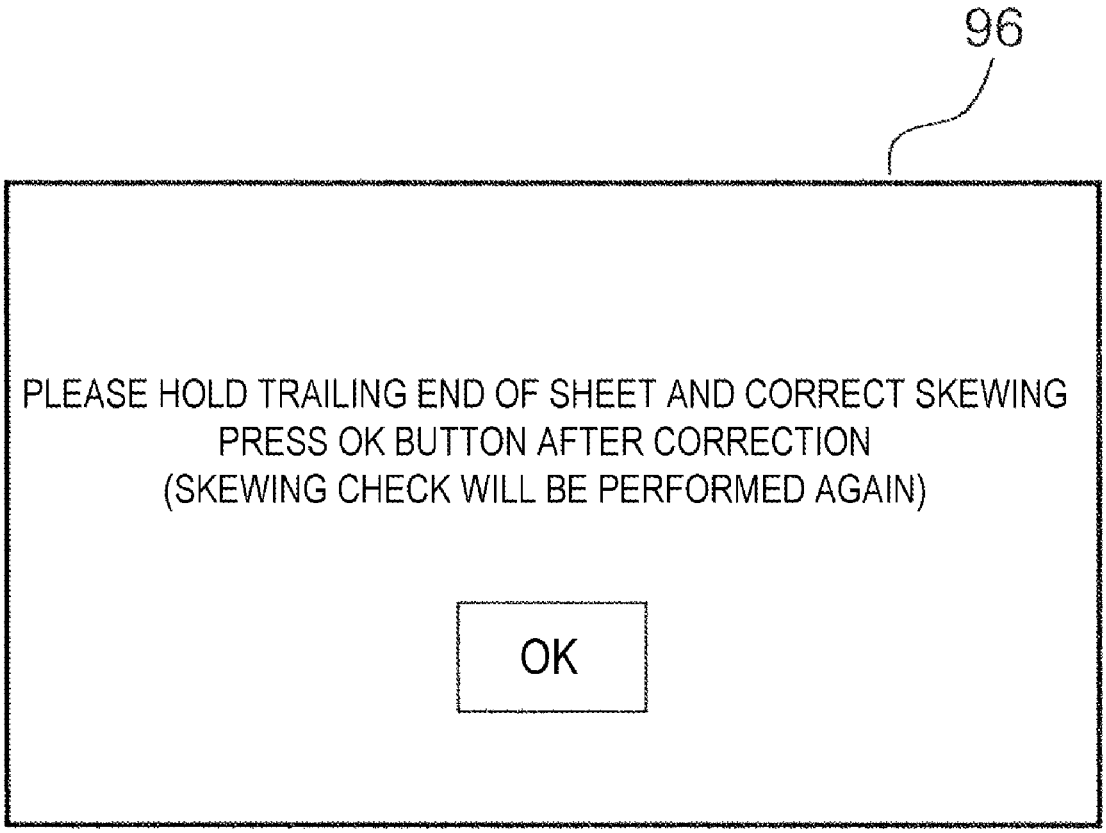
FIG. 12 is a diagram illustrating a UI prompting manual skewing correction for the medium.

The "manual skewing correction" is an example of a third option, and when this is selected, the control unit 50 first switches the nip load of the feed roller pair 15 to "small nip load" (step S107), and then displays a correcting UI (step S108). In FIG. 12, reference sign 96 denotes an example of the correcting UI, and when the user corrects the skewing of the sheet and presses the OK button on this UI, the control unit 50 switches the nip load of the feed roller pair 15 to "large nip load" (step S109), and then executes the processing from step S101 again.

As described above, the printer 1 includes the second medium detection unit 60 that is an edge detection unit configured to detect an edge of the medium P on the medium conveyance path, and the control unit 50 configured to receive detection information from the second medium detection unit 60. The control unit 50 acquires the direction of skewing and the amount of the skewing of the medium P on the conveyance path based on the detection information from the second medium detection unit 60 (step S101 in FIG. 6) and outputs skewing information including the direction of the skewing and the amount of the skewing to an information receiving unit configured to receive the skewing information (step S102 in FIG. 6). In the present embodiment, the information receiving unit is at least one of the operational panel 6 of the printer 1 and the portable information terminal 100.

Thus, the user can recognize not only the occurrence of the skewing of the medium P but also the direction of the skewing and the amount of the skewing, whereby usability can be improved.

In the present embodiment, the control unit 50 displays the skew angle α as the skewing information (skewing information 92) on the operational panel 6 of the printer 1 or the display unit 105 of the portable information terminal 100. Thus, the user can grasp the skew angle α, thereby selecting appropriate processing with the processing UI 93.

In the present embodiment, the control unit 50 displays a graphic indicating the direction of the skewing of the medium P as the skewing information (skewing information 91) on the operational panel 6 of the printer 1 or the display unit 105 of the portable information terminal 100. Thus, the user can more easily recognize the skewing of the medium P.

In the present embodiment, the control unit 50 displays the information about the displacement of the recording image with respect to the medium P as the skewing information (skewing information 92) on the operational panel 6 of the printer 1 or the display unit 105 of the portable information terminal 100.

As a result, the user can select appropriate subsequent processing with the processing UI 93 based on the information about the displacement of the recording image.

Further, in the present embodiment, the control unit 50 displays, together with the skewing information, the processing UI 93 with which the user selects any one of the first option that is selected to execute the recording despite the skewing of the medium P, the second option that is selected to discharge the medium P toward the upstream or downstream of the feed roller pair 15 without performing the recording, and the third option that is selected to manually correct the skewing of the medium P, and executes the processing corresponding to the option selected. Thus, the user can select a desired item based on the skewing information, whereby usability can be improved.

Figure 6:
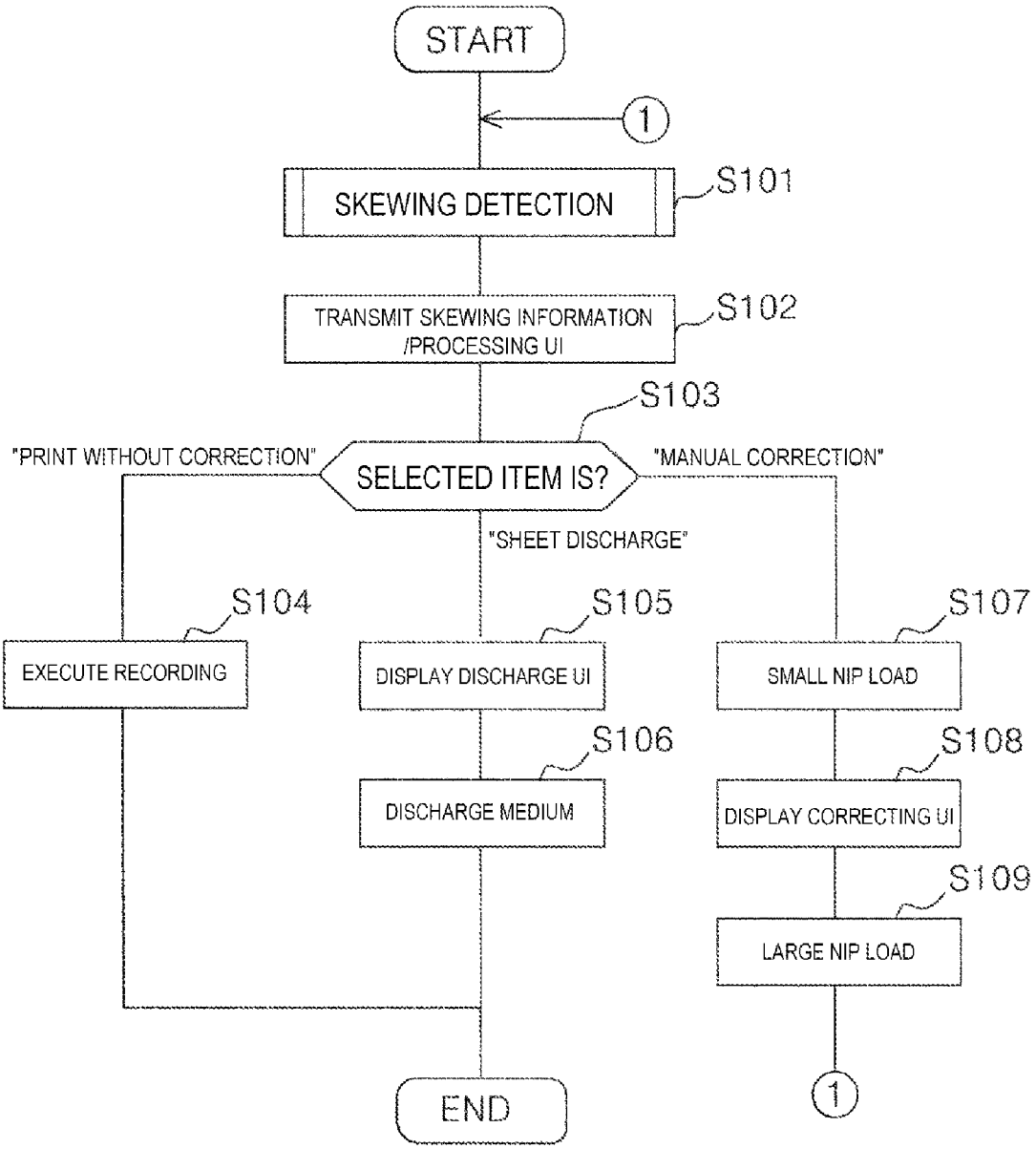
FIG. 6 is a flowchart illustrating control performed by a control unit.

In the present embodiment, when the third option is selected, the control unit 50 reduces the nip load of the feed roller pair 15 (step S107 in FIG. 6). Thus, the rotation of the medium P is facilitated so that the user can easily correct the skewing manually.

Although the nip load of the feed roller pair 15 is reduced in the present embodiment, the nipping of the feed roller pair 15 may be completely released, that is, the nip roller 15*b* may be separated from the feed roller 15*a*.

Although when the third option is selected, the nip load of the feeding roller pair 15 is adjusted in the present embodiment, the nip load of the feeding roller pair 15 may be left as it is without being adjusted.

The present disclosure is not intended to be limited to the aforementioned exemplary embodiment, and many variations are possible within the scope of the present disclosure as described in the appended claims. It goes without saying that such variations also fall within the scope of the present disclosure.

For example, although the skewing information is displayed regardless of the skew angle α of the medium P in the above-described embodiment (step S102 in FIG. 6), the skew angle α may have a threshold, and when the skew angle α is less than the threshold, the recording may be executed without displaying the skewing information. The threshold may be adjustable by the user.

What is claimed is:

1. A recording device comprising:

a conveyance path through which a medium is conveyed;

a recording head configured to perform recording on the medium at the conveyance path;

a conveyance roller located upstream of the recording head on the conveyance path and configured to convey the medium toward the recording head;

an edge detection sensor configured to detect an edge of the medium on the conveyance path;

a control unit configured to receive detection information from the edge detection sensor; and a display screen configured to display various types of information under control of the control unit, wherein the control unit acquires, based on the detection information from the edge detection sensor, a direction of skewing of the medium and an amount of the skewing on the conveyance path, the control unit outputs skewing information including the direction of the skewing and the amount of the skewing, the control causes the display screen to display an angle of the skewing as the skewing information, and the control unit causes the display screen to graphically display a direction of skewing of a medium as the skewing information.

2. The recording device according to claim 1, wherein the control unit causes the display screen to display, as the skewing information, information about displacement of a recording image with respect to the medium.

3. The recording device according to claim 1, wherein the recording head includes a recording head configured to eject ink onto the medium, the recording head being provided to a carriage movable in a width direction intersecting a direction in which the medium is conveyed, and the edge detection sensor includes an optical sensor provided to the carriage at a position facing the medium.

4. The recording device according to claim 1, wherein the control unit outputs the skewing information to a portable information terminal configured to communicate with the control unit.

5. A recording device comprising:

a conveyance path through which a mediums is conveyed;

a recording head configured to perform recording on the medium at the conveyance path;

a conveyance roller located upstream of the recording head on the conveyance path and configured to convey the medium toward the recording head;

an edge detection sensor configured to detect an edge of the medium on the conveyance path;

a control unit configured to receive detection information from the edge detection sensor; and a display screen configured to display various types of information under control of the control unit, wherein the control unit acquire, base on the detection information from the edge detection sensor, a direction of skewing of the medium and an amount of the skewing on the conveyance path, the control unit outputs skewing information including the direction of the skewing and/or the amount of the skewing, the control unit causes the display screen to display an angle of the skewing as the skewing information, and the control unit includes a user interface with which a user selects any one of a first option for performing recording regardless of the skewing, a second option for discharging the medium upstream or downstream of the conveyance roller on the conveyance path, without performing the recording, and a third option for manually correcting the skewing of the medium, and the control unit executes processing corresponding to the option selected.

6. The recording device according to claim 5, wherein the conveyance roller includes a roller pair configured to nip and convey the medium, and the control unit releases the nipping by the roller pair or reduces a nip load of the roller pair, when the third option is selected.

7. A non-transitory computer-readable storage medium storing a program executed by a control unit of a recording device, the recording device including:

a conveyance path through which a medium is conveyed;

a recording head configured to perform recording on the medium at the conveyance path;

a conveyance roller located upstream of the recording head on the conveyance path, and configured to convey the medium to the recording head;

an edge detection sensor configured to detect an edge of the medium on the conveyance path;

the control unit configured to receive detection information from the edge detection sensor; and a display screen configured to display various types of information under control of the control unit, the program being configured to:

acquire, based on the detection information from the edge detection sensor, a direction of skewing of the medium and an amount of the skewing on the conveyance path;

output skewing information including the direction of the skewing and the amount of the skewing;

cause the display screen to display an angle of the skewing as the skewing information; and cause the display screen to graphically display a direction of skewing of a medium as the skewing information.

* * * * *